US012575648B1

(12) United States Patent
Yang et al.

(10) Patent No.: US 12,575,648 B1
(45) Date of Patent: Mar. 17, 2026

(54) SPIKE STRUCTURE MADE OF DIFFERENT MATERIALS AND FEATURING AUGMENTED JOINING STRENGTH

(71) Applicants: Teng-Jen Yang, Taichung City (TW); Jen-Yu Yang, Taichung City (TW)

(72) Inventors: Teng-Jen Yang, Taichung City (TW); Jen-Yu Yang, Taichung City (TW)

( * ) Notice: Subject to any disclaimer, the term of this patent is extended or adjusted under 35 U.S.C. 154(b) by 63 days.

(21) Appl. No.: 18/890,177

(22) Filed: Sep. 19, 2024

(51) Int. Cl.
*A43C 15/16* (2006.01)
*A43B 13/22* (2006.01)

(52) U.S. Cl.
CPC ..... *A43C 15/161* (2013.01); *A43B 13/22* (2013.01); *A43C 15/162* (2013.01)

(58) Field of Classification Search
CPC ... A43C 15/161; A43C 15/162; A43C 15/164; A43C 15/168; A43C 15/16; A43C 13/04; A43B 13/22; A43B 13/24
USPC ..... 36/134, 67 A, 67 R
See application file for complete search history.

(56) References Cited

U.S. PATENT DOCUMENTS 4,492,047 A * 1/1985 Arff ..... A43C 15/161 36/62
5,377,431 A * 1/1995 Walker ..... A43C 15/168 36/134
9,839,255 B2 * 12/2017 Adami ..... B29D 35/142
2007/0251128 A1 * 11/2007 Yen ..... A43C 15/161 36/134
2016/0113357 A1 * 4/2016 Yang ..... A43B 5/02 12/142 T
2024/0065384 A1 2/2024 Yang et al.

FOREIGN PATENT DOCUMENTS

EP 0261557 A2 * 3/1988 ..... A43B 13/26

* cited by examiner

*Primary Examiner* — Jameson D Collier
(74) *Attorney, Agent, or Firm* — Wang Law Firm, Inc.

(57) ABSTRACT

A spike structure made of different materials and featuring augmented joining strength includes: a sole protruding component including a joining ring portion, first and second joining portions disposed at two ends of the joining ring portion respectively; an interface component including a middle portion disposed in the joining ring portion, first and second receding portions disposed at two ends of the middle portion and joined to the first and second joining portions respectively, with the first and second receding portions being of a smaller thickness than the middle portion and thus receding toward each other so as to clamp and join to the sole protruding component; and a spike component joined to the first receding portion. Owing to the structural design and material contraction of the interface component upon injection, the interface component and spike component are firmly adhered together to enhance structural strength and stability of the spike.

7 Claims, 4 Drawing Sheets

SPIKE STRUCTURE MADE OF DIFFERENT MATERIALS AND FEATURING AUGMENTED JOINING STRENGTH

BACKGROUND

Field of the Invention

The present disclosure relates to spike structures made of different materials, and more particularly to a spike structure made of different materials and featuring augmented joining strength.

Description of Related Art

Cleats are used in sports, such as football, soccer, and baseball. Referring to FIG. 1A, there is shown a cross-sectional view of a spike 11 of conventional cleats. The spike 11 includes a sole protruding component 111 and a spike component 112 which are made of different materials. The sole protruding component 111 is integrally formed on the outsole (not shown) and has hardness greater than the spike component 112. The spike component 112 is disposed in the sole protruding component 111 and partially exposed from the sole protruding component 112.

Conventionally, the sole protruding component 111 is made of polypropylene (PP), and the spike component 112 is made of thermoplastic polyurethane (TPU). However, polypropylene (PP) is crystalline plastic and thus is excellent in terms of chemical resistance and pharmaceutical resistance; as a result, it is difficult for polypropylene (PP) to be joined to or adhered to other plastics. In particular, it is difficult for polypropylene (PP) to be adhered to thermoplastic polyurethane (TPU). As a result, when conventional cleats are in use, the spike component 112 is likely to deform under an external bending force and separate from the sole protruding component 111 or get damaged.

Referring to FIG. 1B, the U.S. publication No. 20240065384A1 discloses a spike structure made of different materials comprising an interface component 12 that serves as a connector for joining the sole protruding component 13 and the spike component 14 to prevent the detachment of the spike component 14 from the sole protruding component 13. Both the interface component 12 and the sole protruding component 13 are made of hard materials substantially equal in hardness, and thus the interface component 12 and the sole protruding component 13 can be firmly joined to each other. Furthermore, the interface component 12 and the spike component 14 are similar in terms of material characteristics and thus can be firmly adhered to each other, enhancing the structural strength and stability of the spike.

However, the U.S. publication No. 20240065384A1 has a drawback: the joining strength of the interface component 12, sole protruding component 13 and spike component 14 is attained through material characteristics only and in consequence fails to meet the demand for spikes with high joining strength.

SUMMARY

It is an objective of the disclosure to provide a spike structure made of different materials and featuring augmented joining strength to overcome the aforesaid and other drawbacks of the prior art.

To achieve the above and other objectives, the disclosure is a spike structure made of different materials and featuring augmented joining strength, comprising: a sole protruding component made of polypropylene (PP) and comprising a joining ring portion, a first joining portion disposed at an end of the joining ring portion, and a second joining portion disposed at another end of the joining ring portion; an interface component comprising a middle portion disposed in the joining ring portion, a first receding portion disposed at an end of the middle portion, extended outward, and joined to the first joining portion from outside, wherein the first receding portion is exposed to an external environment, and a second receding portion disposed at another end of the middle portion, extended outward, and joined to the second joining portion from outside, wherein the second receding portion has an uppermost surface that is flush with an uppermost surface of the sole protruding component, wherein the first receding portion and the second receding portion are of a smaller thickness than the middle portion and thus recede toward each other so as to clamp and join to the sole protruding component; and a spike component made of thermoplastic polyurethane (TPU), joined to the first receding portion, and exposed from the sole protruding component, wherein the spike component is entirely vertically beneath the interface component.

The advantages of the disclosure are described below. Both the first receding portion and the second receding portion are extended outward from the middle portion. The thicknesses of the first receding portion and the second receding portion are less than the thickness of the middle portion to not only allow the first receding portion to differ from the middle portion in terms of the extent to which they recede but also allow the second receding portion to differ from the middle portion in terms of the extent to which they recede, so as to allow the first receding portion and the second receding portion to not only recede toward each other but also recede to an increasing extent away from the middle portion, allowing the interface component to firmly clamp and join to the sole protruding component. Owing to the structural design and material contraction of the interface component upon injection, the interface component and the sole protruding component are firmly adhered together to enhance structural strength and stability of the spike.

DETAILED DESCRIPTION

Figure 1A:
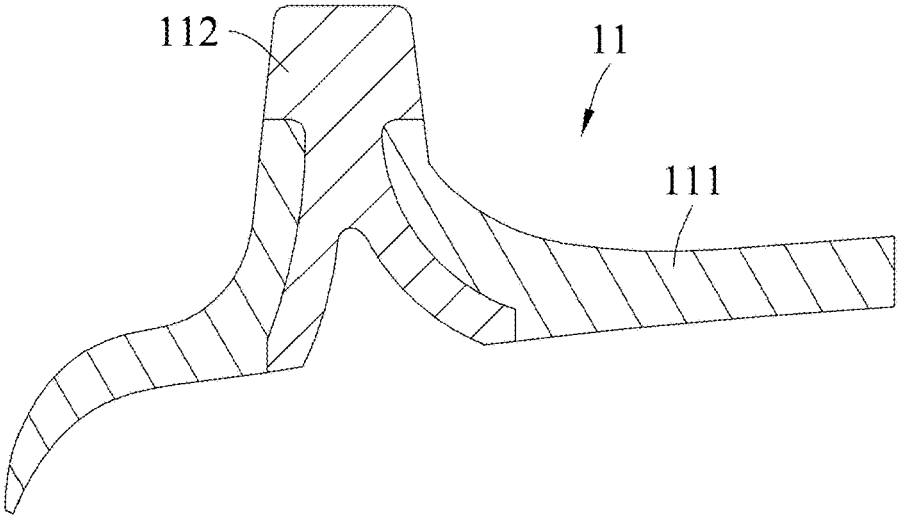
FIG.1A PRIOR ART
FIG. 1A is a cross-sectional view of a spike of conventional cleats.
Figure 1B:
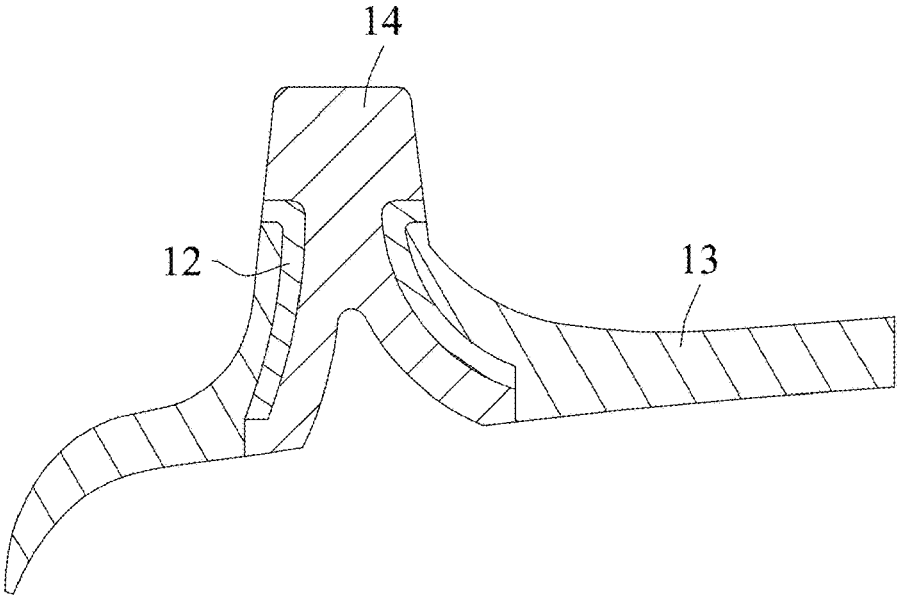
FIG.1B PRIOR ART
FIG. 1B is a cross-sectional view, one of the diagrams of the U.S. publication No. 20240065384A1.
Figure 2:
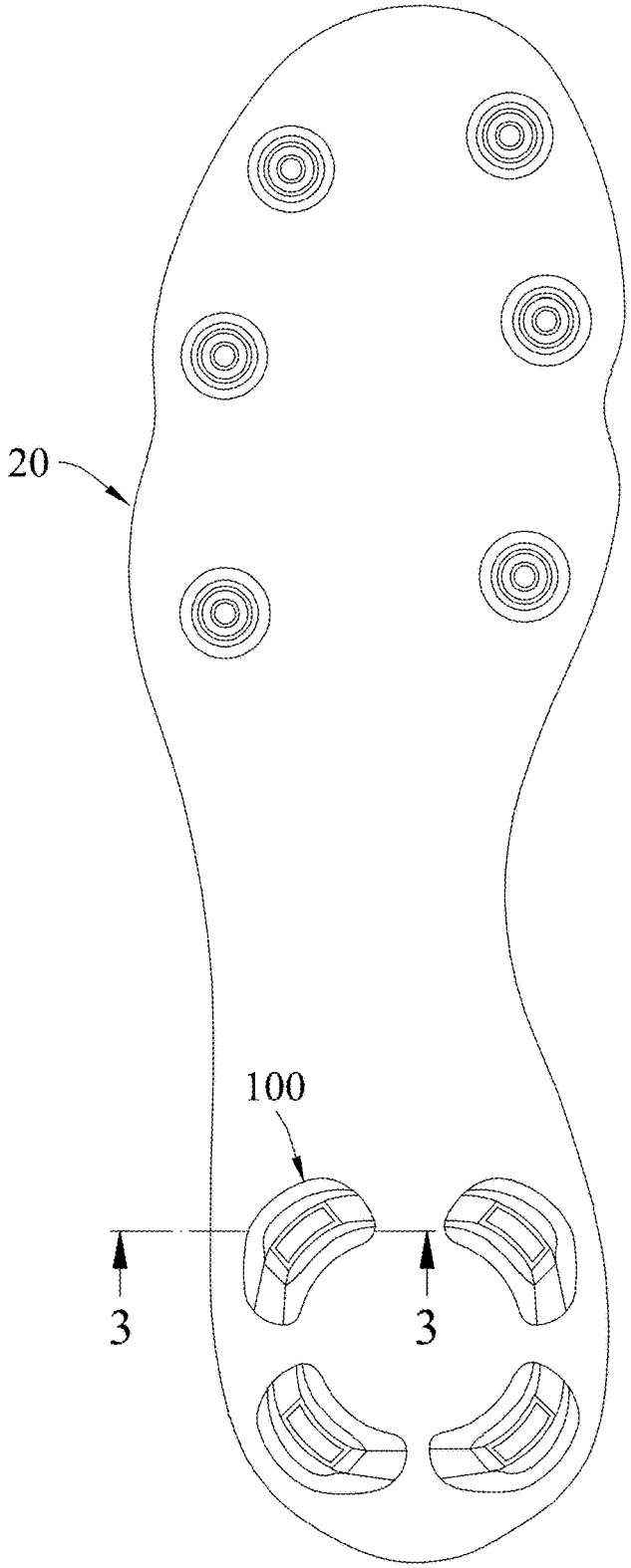
FIG. 2 is a bottom view of a spike structure formed on an outsole according to the disclosure.
Figure 3:
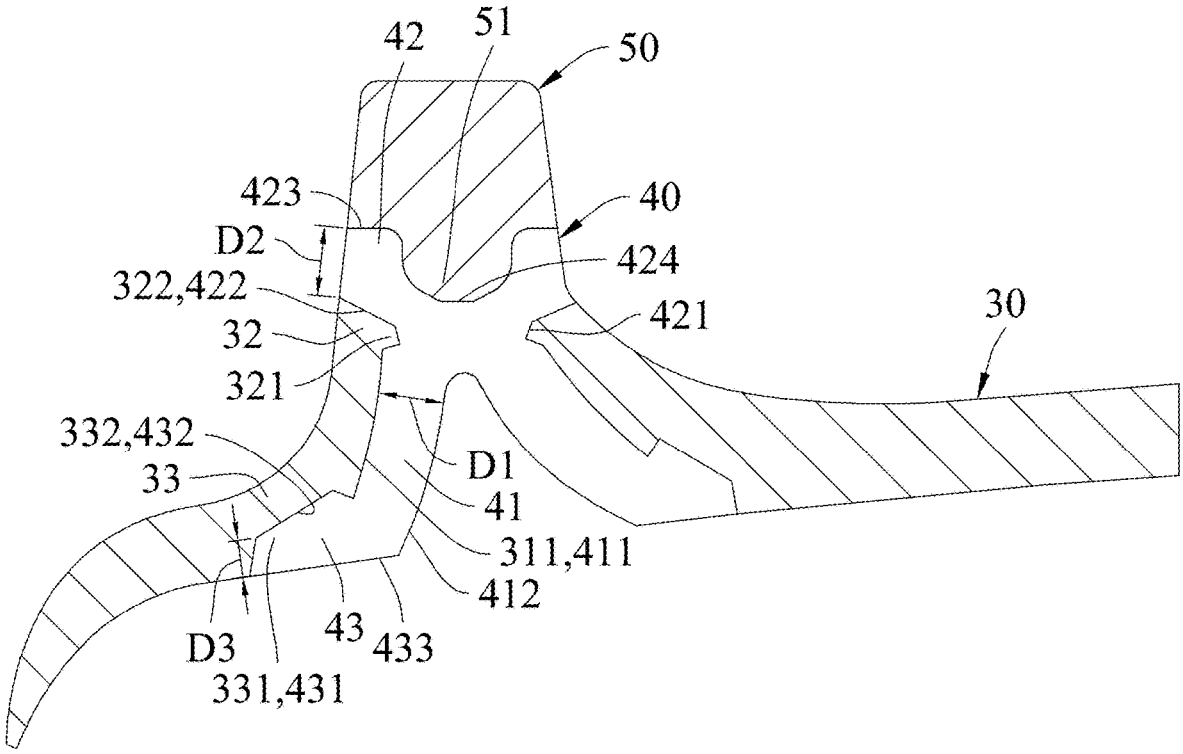
FIG. 3 is a cross-sectional view taken along line 3-3 of FIG. 2.

Referring to FIG. 2 and FIG. 3, an embodiment of the disclosure provides a spike structure 100 made of different materials and featuring augmented joining strength. Suitable for being formed on an outsole 20, the spike structure 100 made of different materials and featuring augmented joining strength essentially comprises a sole protruding component 30, an interface component 40, and a spike component 50.

Figure 4A:
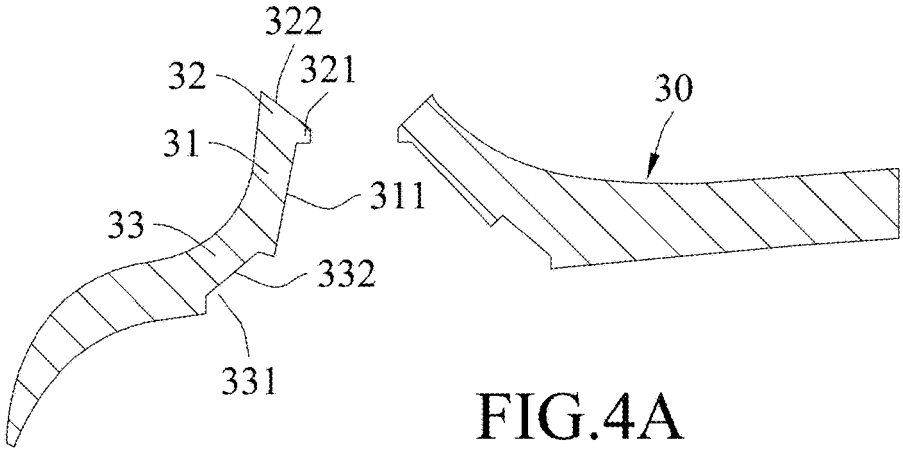
FIG. 4A is a cross-sectional view, showing the formation state (1) of the spike structure of the disclosure.

Referring to FIG. 4A, the sole protruding component 30 is made of polypropylene (PP) and formed on the outsole 20. The sole protruding component 30 comprises a joining ring portion 31, a first joining portion 32 disposed at one end of the joining ring portion 31, and a second joining portion 33 disposed at the other end of the joining ring portion 31. In this embodiment, the joining ring portion 31 has a joining inner annular surface 311. The first joining portion 32 of the sole protruding component 30 has a joining bump 321 and a first joining surface 322. The second joining portion 33 of the sole protruding component 30 has a joining sunken portion 331 and a second joining surface 332.

Figure 4B:
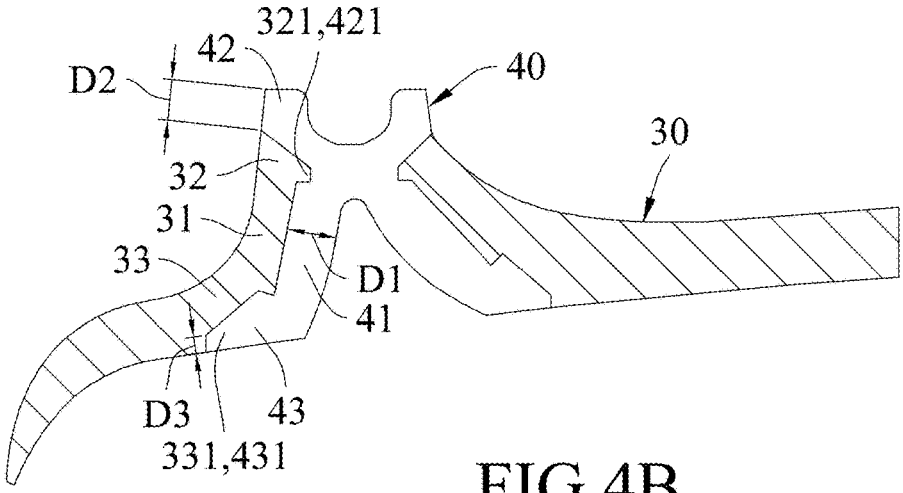
FIG. 4B is a cross-sectional view, showing the formation state (2) of the spike structure of the disclosure.
Figure 4C:
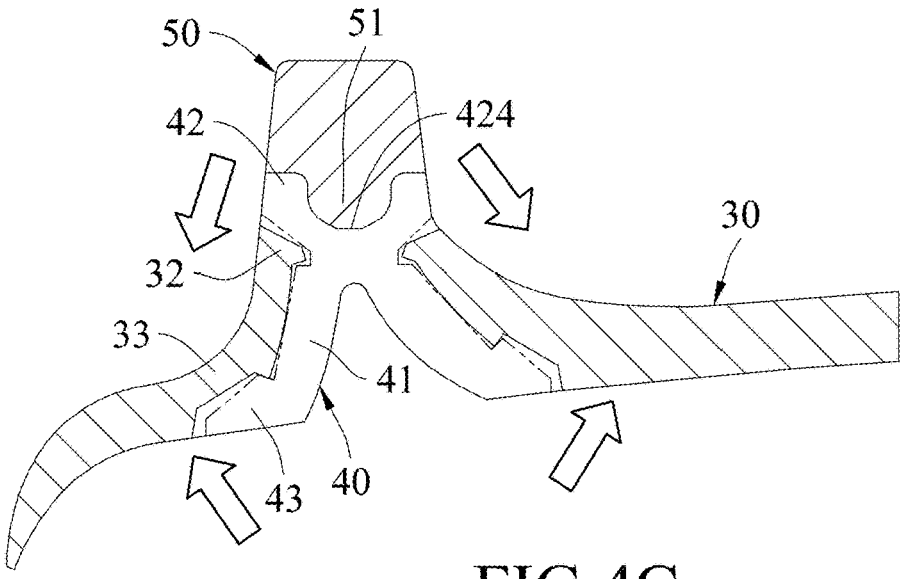
FIG. 4C is a cross-sectional view, showing the formation state (3) of the spike structure of the disclosure.

Referring to FIG. 4B, the interface component 40 comprises a middle portion 41 disposed in the joining ring portion 31, a first receding portion 42 disposed at one end of the middle portion 41, extended outward, and joined to the first joining portion 32 from outside, wherein the first receding portion 42 is exposed to an external environment, a second receding portion 43 disposed at the other end of the middle portion 41, extended outward, and joined to the second joining portion 33 from outside, wherein the second receding portion 43 has an uppermost surface that is flush with an uppermost surface of the sole protruding component 30. The thicknesses D2, D3 of the first receding portion 42 and the second receding portion 43 are less than the thickness D1 of the middle portion 41; thus, the first receding portion 42 and the second receding portion 43 recede toward each other (as shown in FIG. 4C) so as to clamp and join to the sole protruding component 30. The thicknesses D2, D3 of the first receding portion 42 and the second receding portion 43 range from 1.0 mm to 1.5 mm, and the thickness D1 of the middle portion ranges from 2.0 mm to 3.0 mm.

In this embodiment, the first receding portion 42 of the interface component 40 has a receding sunken portion 421 enclosing the joining bump 321, a first receding inner surface 422 pressing against the first joining surface 322, a first receding outer surface 423 facing away from the first receding inner surface 422, and a joining concave portion 424 sinking toward the middle portion 41, allowing the first receding portion 42 of the interface component 40 to concavely and convexly match the first joining portion 32 of the sole protruding component 30, but the disclosure is not limited thereto. In a variant embodiment, the first receding portion 42 is designed to be in the form of a bump, and the first joining portion 32 is designed to be in the form of a sunken portion. In addition, preferably, the opening of the joining concave portion 424 constricts.

The second receding portion 43 of the interface component 40 has a receding raised portion 431 embedded in the joining sunken portion 331, a second receding inner surface 432 pressing against the second joining surface 332, and a second receding outer surface 433 facing away from the second receding inner surface 432, allowing the second receding portion 43 of the interface component 40 to concavely and convexly match the second joining portion 33 of the sole protruding component 30, but the disclosure is not limited thereto. In a variant embodiment, the second receding portion 43 is designed to be in the form of a sunken portion, and the second joining portion 33 is designed to be in the form of a bump.

The middle portion 41 of the interface component 40 has a middle outer annular surface 411 pressing against the joining inner annular surface 311 and a middle inner annular surface 412 facing away from the middle outer annular surface 411. The thickness D2 of the first receding portion 42 is the shortest distance between the first receding inner surface 422 and the first receding outer surface 423. The thickness D3 of the second receding portion 43 is the shortest distance between the second receding inner surface 432 and the second receding outer surface 433. The thickness D3 of the second receding portion 43 increases toward the middle portion 41. The thickness D1 of the middle portion 41 is the shortest distance between the middle outer annular surface 411 and the middle inner annular surface 412.

The interface component 40 is made of polycarbonate (PC), but the disclosure is not limited thereto. In a variant embodiment, the interface component 40 is made of acrylonitrile-butadiene-styrene copolymer (ABS), thermoplastic polyurethane (TPU) of Shore D hardness ranging from 55 to 75, a mixture of acrylonitrile-butadiene-styrene copolymer (ABS) and thermoplastic polyurethane (TPU), a mixture of thermoplastic polyurethane (TPU) and glass fiber (GF), a mixture of polycarbonate (PC) and acrylonitrile-butadiene-styrene copolymer (ABS), PEBAX® (a type of polyether block amide), or a mixture of PEBAX® (a type of polyether block amide) and glass fiber (GF), ensuring augmented joining strength between the interface component 40 and the sole protruding component 30 and augmented joining strength between the interface component 40 and the spike component 50.

The spike component 50 is made of thermoplastic polyurethane (TPU). The spike component 50 is joined to the first receding portion 42 and exposed from the sole protruding component 30, wherein the spike component 50 is entirely vertically beneath the interface component 40. In this embodiment, the spike component 50 has a joining convex portion 51 joined to the joining concave portion 424 and the first receding outer surface 423 pressing against the interface component 40 to increase the contact area between the spike component 50 and the interface component 40 and thereby augment the joining strength between the spike component 50 and the interface component 40.

Essential components in the embodiments of the disclosure are described above. The advantages of the disclosure are described below.

Referring to FIG. 4A, after being formed, the sole protruding component 30 particularly has the joining ring portion 31, the first joining portion 32 with the joining bump 321, and the second joining portion 33 with the joining sunken portion 331.

Referring to FIG. 4B, after the interface component 40 has undergone injection processing so as to be injected into the sole protruding component 30, it is feasible for the middle portion 41 of the interface component 40 to be disposed in the joining ring portion 31, for the first receding portion 42 of the interface component 40 to be joined to the first joining portion 32, for the receding sunken portion 421 of the interface component 40 to enclose the joining bump 321, for the second receding portion 43 of the interface component 40 to be joined to the second joining portion 33, for the receding raised portion 431 of the interface component 40 to be embedded in the joining sunken portion 331, and for the thicknesses D2, D3 of the first receding portion 42 and the second receding portion 43 to be defined as less than the thickness D1 of the middle portion 41.

Referring to FIG. 4B and FIG. 4C, after the interface component 40 has been injected into the sole protruding component 30, the interface component 40 recedes. Since the thicknesses D2, D3 of the first receding portion 42 and the second receding portion 43 differ from the thickness D1 of the middle portion 41, the first receding portion 42, second receding portion 43, and middle portion 41 of the interface component 40 differ in terms of the extent to which they recede. The dash-dotted lines in FIG. 4C indicate the positions of the first receding portion 42, second receding portion 43, and middle portion 41 of the interface component 40 before they recede. The first receding portion 42 and the second receding portion 43 recede toward each other in the receding directions indicated by the arrows in FIG. 4C, allowing the interface component 40 to clamp and join to the sole protruding component 30.

Therefore, the advantages of the disclosure are described below. Both the first receding portion 42 and the second receding portion 43 are extended outward from the middle portion 41. The thicknesses D2, D3 of the first receding portion 42 and the second receding portion 43 are less than the thickness D1 of the middle portion 41 to not only allow the first receding portion 42 to differ from the middle portion 41 in terms of the extent to which they recede but also allow the second receding portion 43 to differ from the middle portion 41 in terms of the extent to which they recede, so as to allow the first receding portion 42 and the second receding portion 43 to not only recede toward each other but also recede to an increasing extent away from the middle portion 41, allowing the interface component 40 to firmly clamp and join to the sole protruding component 30. Owing to the structural design and material contraction of the interface component 40 upon injection, the interface component 40 and the sole protruding component 30 are firmly adhered together to enhance structural strength and stability of the spike.

What is claimed is:

1. A spike structure comprising:

a sole protruding component made of polypropylene (PP) and comprising a joining ring portion, a first joining portion disposed at an end of the joining ring portion, and a second joining portion disposed at another end of the joining ring portion;

an interface component comprising:

a middle portion disposed in the joining ring portion, a first receding portion disposed at an end of the middle portion, extended outward, and joined to the first joining portion, wherein the first receding portion is exposed to an external environment, and a second receding portion disposed at another end of the middle portion, extended outward, and joined to the second joining portion, wherein the second receding portion has an uppermost surface that is flush with an uppermost surface of the sole protruding component, wherein the first receding portion and the second receding portion each have a respective thickness that is less than a thickness of the middle portion and recede toward each other, wherein the first receding portion and the second receding portion are clamped and joined to the sole protruding component; and a spike component made of thermoplastic polyurethane (TPU), wherein the spike component is joined to the first receding portion and exposed from the sole protruding component, wherein the spike component is entirely vertically beneath the interface component.

2. The spike structure according to claim 1, wherein the first receding portion of the interface component is shaped to match the first joining portion of the sole protruding component, and the second receding portion of the interface component is shaped to match the second joining portion of the sole protruding component.

3. The spike structure according to claim 1, wherein the first joining portion of the sole protruding component has a joining bump, the first receding portion of the interface component has a receding sunken portion enclosing the joining bump, the second joining portion of the sole protruding component has a joining sunken portion, and the second receding portion of the interface component has a receding raised portion embedded in the joining sunken portion.

4. The spike structure according to claim 1, wherein the joining ring portion has a joining inner annular surface, the first joining portion has a first joining surface, the second joining portion has a second joining surface, the middle portion has a middle outer annular surface pressing against the joining inner annular surface and a middle inner annular surface facing away from the middle outer annular surface, the first receding portion has a first receding inner surface pressing against the first joining surface and a first receding outer surface facing away from the first receding inner surface, and the second receding portion has a second receding inner surface pressing against the second joining surface and a second receding outer surface facing away from the second receding inner surface, defining a shortest distance between the first receding inner surface and the first receding outer surface as the thickness of the first receding portion, defining a shortest distance between the second receding inner surface and the second receding outer surface as the thickness of the second receding portion, and defining a shortest distance between the middle outer annular surface and the middle inner annular surface as the thickness of the middle portion.

5. The spike structure according to claim 1, wherein the thickness of the second receding portion increases toward the middle portion.

6. The spike structure according to claim 1, wherein the first receding portion of the interface component has a joining concave portion sinking toward the middle portion, and the spike component has a joining convex portion joined to the joining concave portion.

7. The spike structure according to claim 1, wherein the interface component is made of one of polycarbonate (PC), acrylonitrile-butadiene-styrene copolymer (ABS), thermoplastic polyurethane (TPU) of Shore D hardness ranging from 55 to 75, a mixture of acrylonitrile-butadiene-styrene copolymer (ABS) and thermoplastic polyurethane (TPU), a mixture of thermoplastic polyurethane (TPU) and glass fiber (GF), a mixture of polycarbonate (PC) and acrylonitrile-butadiene-styrene copolymer (ABS), polyether block amide, and a mixture of polyether block amide and glass fiber (GF).

* * * * *